US007347326B2

(12) United States Patent
Baechle

(10) Patent No.: US 7,347,326 B2
(45) Date of Patent: Mar. 25, 2008

(54) MULTIPLE ANGLE TUBULAR CONTAINER

(75) Inventor: James Baechle, Hendersonville, TN (US)

(73) Assignee: Sonoco Development, Inc., Hartsville, SC (US)

( * ) Notice: Subject to any disclaimer, the term of this patent is extended or adjusted under 35 U.S.C. 154(b) by 603 days.

(21) Appl. No.: 10/904,782

(22) Filed: Nov. 29, 2004

(65) Prior Publication Data

US 2006/0116024 A1 Jun. 1, 2006

(51) Int. Cl.
*B65D 5/00* (2006.01)

(52) U.S. Cl. ..... 206/453; 206/784; 229/115; 229/164.2

(58) Field of Classification Search ..... 229/108, 229/108.1, 115, 164.2; 206/273, 446, 453, 206/784, 335

See application file for complete search history.

(56) References Cited

U.S. PATENT DOCUMENTS 4,051,993 A * 10/1977 Castoldi, Jr. ..... 229/115
4,779,723 A * 10/1988 Focke et al. ..... 206/273
4,865,371 A * 9/1989 Egberg ..... 294/1.3
5,105,971 A * 4/1992 Hertenstein et al. ..... 229/225
5,158,664 A * 10/1992 Colgan et al. ..... 206/242
5,417,341 A 5/1995 Petriekis et al.
5,425,499 A 6/1995 Pfieffer
5,873,514 A * 2/1999 Brooks ..... 229/115
6,209,783 B1 4/2001 Collins
6,227,441 B1 5/2001 Sagel et al.

* cited by examiner

*Primary Examiner*—Jacob K. Ackun, Jr.
(74) *Attorney, Agent, or Firm*—Clausen Miller, PC

(57) ABSTRACT

A tubular container that can be bent at multiple angles to hold and protect irregular (non-straight) items. The container comprises at least one rigid, hollow straight section and at least one hollow tubular connector piece. The connector piece is configured to fit partially within the straight sections and comprises at least one V-shaped notch at which the tubular container can bend.

5 Claims, 5 Drawing Sheets

MULTIPLE ANGLE TUBULAR CONTAINER

FIELD OF THE INVENTION

This patent relates to a container for holding and shipping non-straight products such as automobile body molding, vehicle brake lines or other bent tubing products.

DESCRIPTION OF THE RELATED ART

Round tubular shipping containers (i.e. tubular containers having round cross-sections) are useful for protecting and shipping straight products such as window blinds, golf clubs and fishing poles. However, round shipping containers can roll off flat tables and conveyor belts and generally are limited to items that are straight. Even non-round or flat sided tubular shipping containers, if rigid, generally cannot be used to protect irregular (non-straight) items because they cannot bend.

The present invention overcomes these disadvantages by providing a rigid, flat-sided tubular shipping tube that can bend at various angles in order to accommodate irregular shaped (non-straight) items.

Further objects of the invention will appear from the description, accompanying drawings, and appended claims.

SUMMARY OF THE INVENTION

The present invention is a tubular container that can be bent at multiple angles to hold and protect irregular (non-straight) items. The container comprises at least one rigid, hollow straight section and at least one hollow tubular elbow or connector piece. The connector is configured to fit partially within the straight sections and comprises at least one V-shaped notch at which the tubular container can bend.

Each straight section is formed from a folded blank and has a polygonal cross-section. For example, in a preferred embodiment, each straight section comprises four substantially rectangular panels folded into a tubular shape having a triangular cross-section.

Each connector is also formed from a folded blank and has a polygonal cross-section. The blank comprises cut out sections that, when the blank is folded, form the V-shaped notches. In a preferred embodiment, each connector comprises four substantially rectangular panels folded into a tubular shape having a triangular cross-section. Each connector is slightly smaller than the straight sections so that it can fit within the straight sections.

To assemble a tubular container, a connector is inserted inside either end of a center straight section up to the desired V-shaped notch. A second connector may be inserted into the opposing end of the straight section up to a V-shaped notch having the same or a different angle as the notch on the first connector. Additional straight sections may be slid over the connectors up to the V-shaped notches, leaving the notches exposed so that the container can bend at the notches. The assembled container can be bent or folded up to the predetermined angle(s) defined by the notches with the connectors acting as hinges.

Any number of straight sections may be connected using the connectors. End caps may be used to cover the exposed ends of the assembled container.

THE DRAWINGS

DETAILED DESCRIPTION OF THE INVENTION

Figure 1:
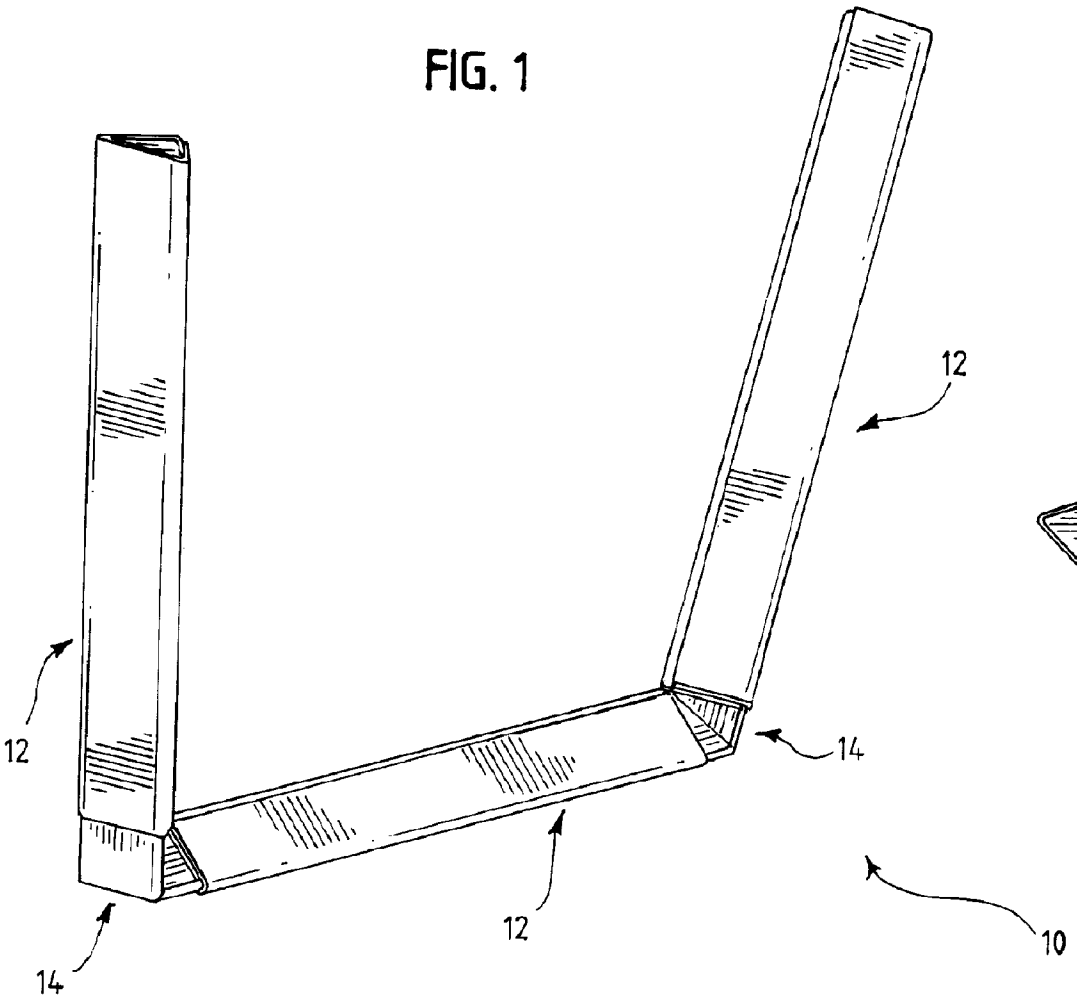
FIG. 1 is a perspective view of a multiple angle tubular container according to the present invention.

Turning to the drawings, there is shown in FIG. 1 one embodiment of the present invention, a rigid, non-round tubular shipping container 10 useful for protecting and shipping straight or non-straight items. In the preferred embodiment shown, the container 10 comprises two or more (n) rigid straight sections 12 joined by (n−1) connectors 14. However, the invention may comprise a single straight section 12 and either one or two connectors 14.

Figure 2:
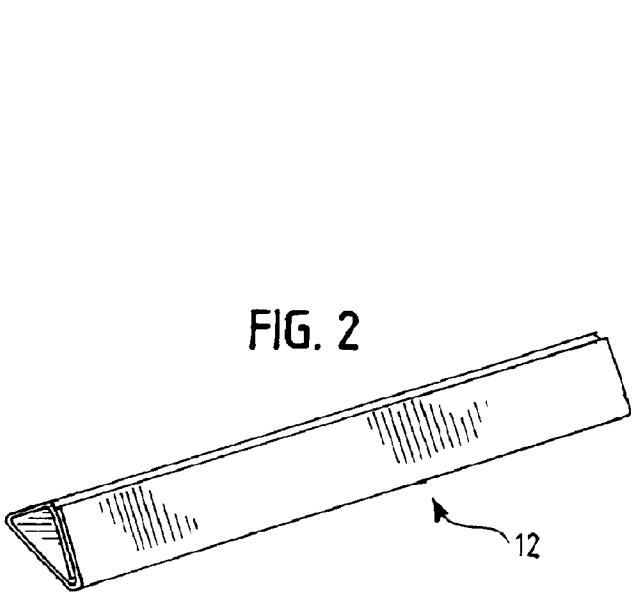
FIG. 2 is a perspective view of a straight section used in the container of FIG. 1.
Figure 2A:
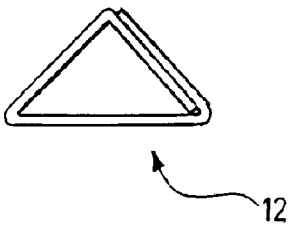
FIG. 2A is an elevational view of an end of the straight section of FIG. 2.

FIG. 2 is a perspective view and FIG. 2A is an end view of a straight section 12. In the illustrated embodiment, the straight section 12 comprises four substantially rectangular panels joined together along fold lines to form a rigid, hollow tubular structure with opposing ends. Each straight section 12 may be formed from a blank (not shown) that has been folded lengthwise such that one panel overlaps and is affixed to another panel by adhesive or other means as best shown in FIG. 2A. The blank may be formed from paperboard, corrugated board, plastic, metal or other suitable material. Alternatively, the straight sections 12 (and the connectors 14) may be formed by molding, extrusion (particularly if the straight section is plastic), or any other suitable means.

The straight sections 12 may have a triangular cross section as shown in the figures, or any suitable cross sectional shape, such as a rectangle or other polygon. The straight sections 12 have an internal bore that can accommodate the connectors 14 and may be cut to any length.

Figure 3:
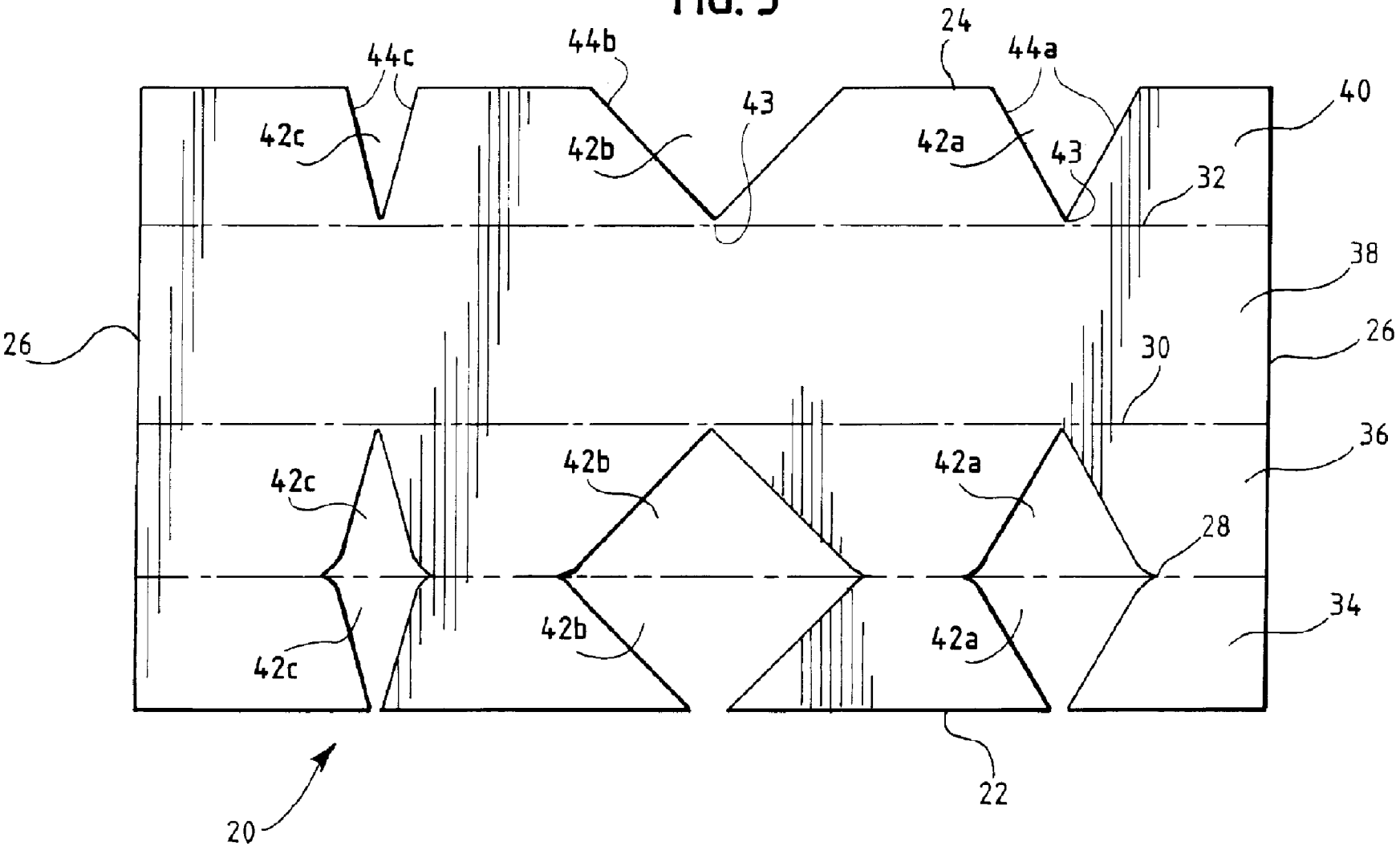
FIG. 3 is a top plan view of a blank used to make a connector used in the container of FIG. 1.

FIG. 3 is a plan view of a blank 20 used to form a connector 14. The blank 20 may be made from corrugated board, paperboard, plastic, metal or other suitable material, and comprises first and second edges 22, 24 extending between opposing ends 26. In the illustrated embodiment, parallel fold lines 28, 30, 32 extend longitudinally between the ends 26, dividing the blank into four substantially rectangular panels: a bottom panel 38, side panels 36, 40, and an overlapping panel 34.

In a key aspect of the invention, one or more V-shaped sections 42 are cut out of the side panels 36, 40 and the overlapping panel 34 such that, when the blank 20 is folded, the V-shaped cut out sections 42 align to form V-shaped notches 16 where the connector 14 can be bent, as explained more fully below.

For example, first V-shaped sections 42*a* may be cut out of side panels 36, 40 at an angle of 60 degrees such that their apexes 43 are adjacent the bottom panel 36. Another V-shaped section 42*a* is cut out of the overlapping panel 34 such that its base (the side away from the apex) adjoins the base of the V-shaped section 42*a* cut out of the side panel 36.

Each of the three V-shaped cut out sections 42*a* is defined by opposing edges 44*a*. When the blank 20 is assembled into a tubular connector 14 the opposing edges 44*a* define two planes that intersect at a 60 degree angle.

Likewise, second and third V-shaped sections 42*b*, 42*c* may be cut out of side panels 36, 40 and the overlapping panel 34 at angles of 90 and 30 degrees respectively so that, when the blank 20 is assembled into a tubular connector 14, two additional V-shaped notches 16*b*, 16*c* are formed having opposing edges 44*b*, 44*c* that intersect at 90 and 30 degrees respectively.

FIGS. 4-7 show various views of an assembled connector 14. To assemble the connector 14, the blank 20 is folded at the fold lines 28, 30, 32 and the overlapping panel 34 may be glued or otherwise affixed to the side panel 40.

Figure 4:
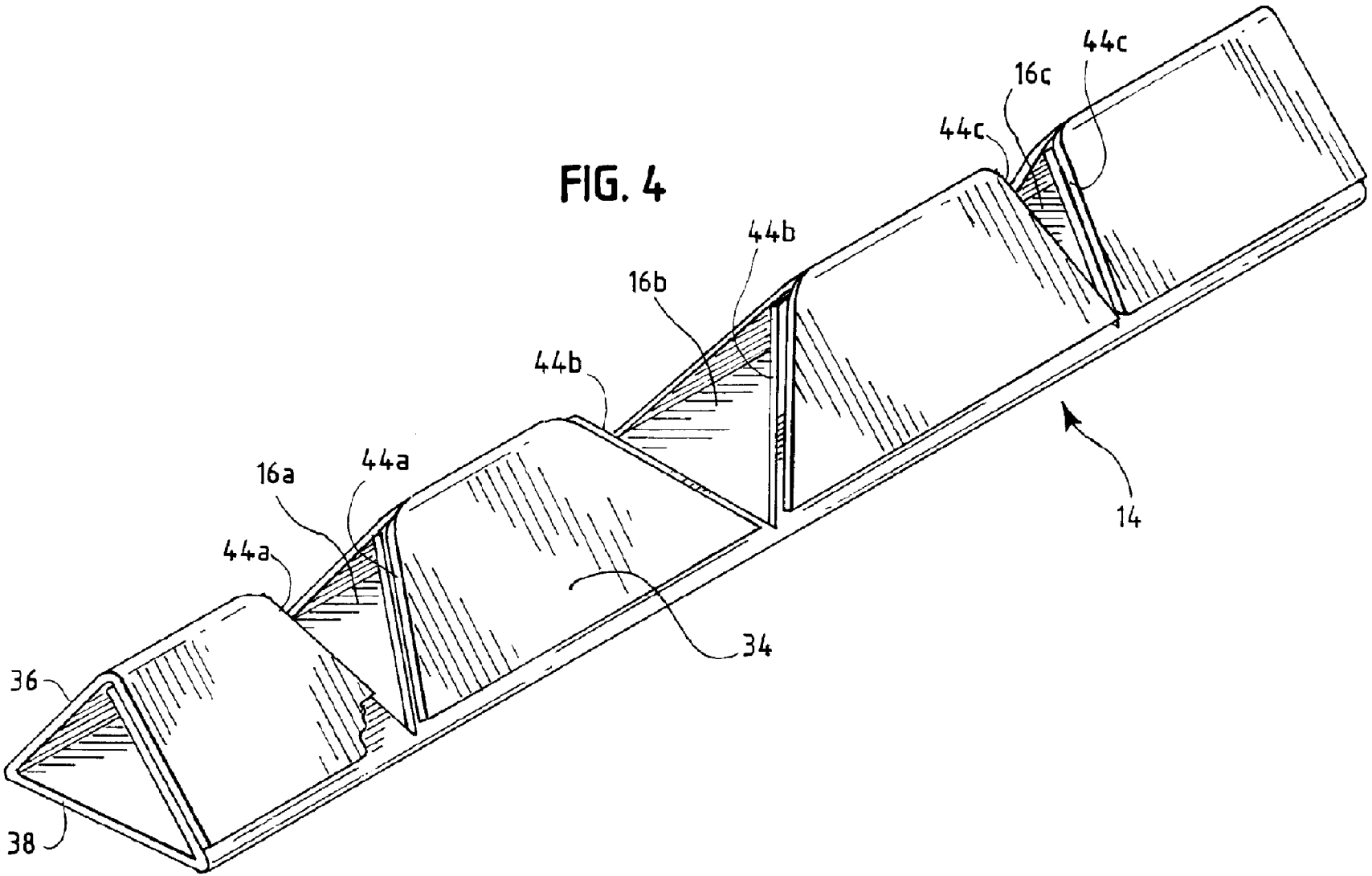
FIG. 4 is a perspective view of a connector used in the container of FIG. 1.
Figure 5:
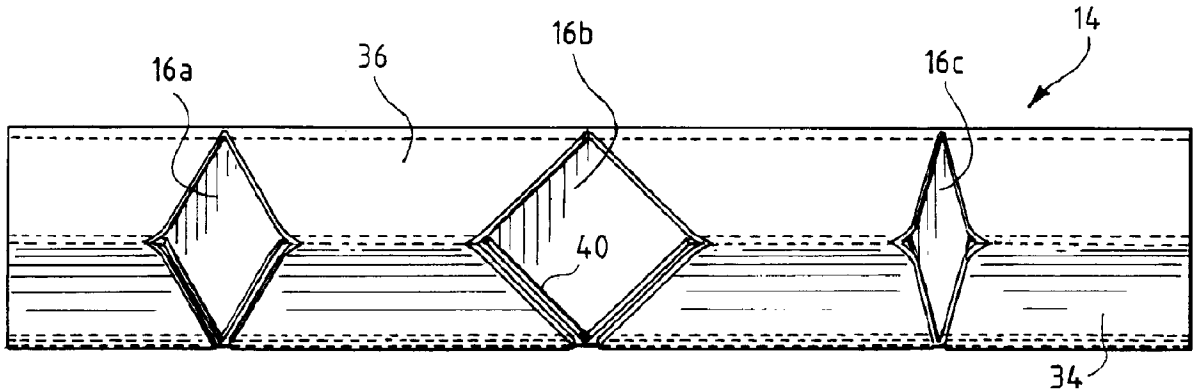
FIG. 5 is a top view of the connector of FIG. 4.
Figure 6:
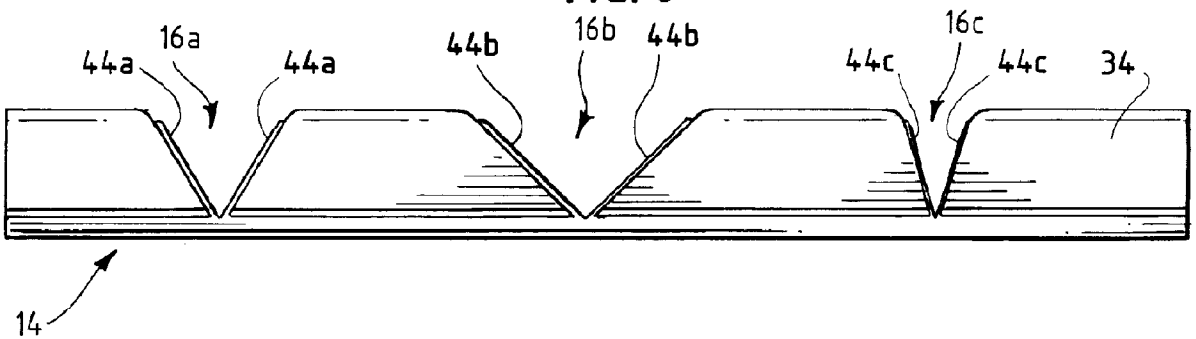
FIG. 6 is a side view of the connector of FIG. 4.

The angle of the V-shaped notches 16 determines the angle at which the connector 14 may be folded. For example, if the angle of the notch 16 is 90 degrees (see V-shaped notch 16*b*), then the connector 14 may be folded at a 90 degree angle, which will cause the opposing edges 44*b* to abut. As shown in FIGS. 4-6, multiple notches 16*a*, 16*b*, 16*c* having varying angles may be die cut into a single connector 14 to provide multiple folding angles.

Figure 8:
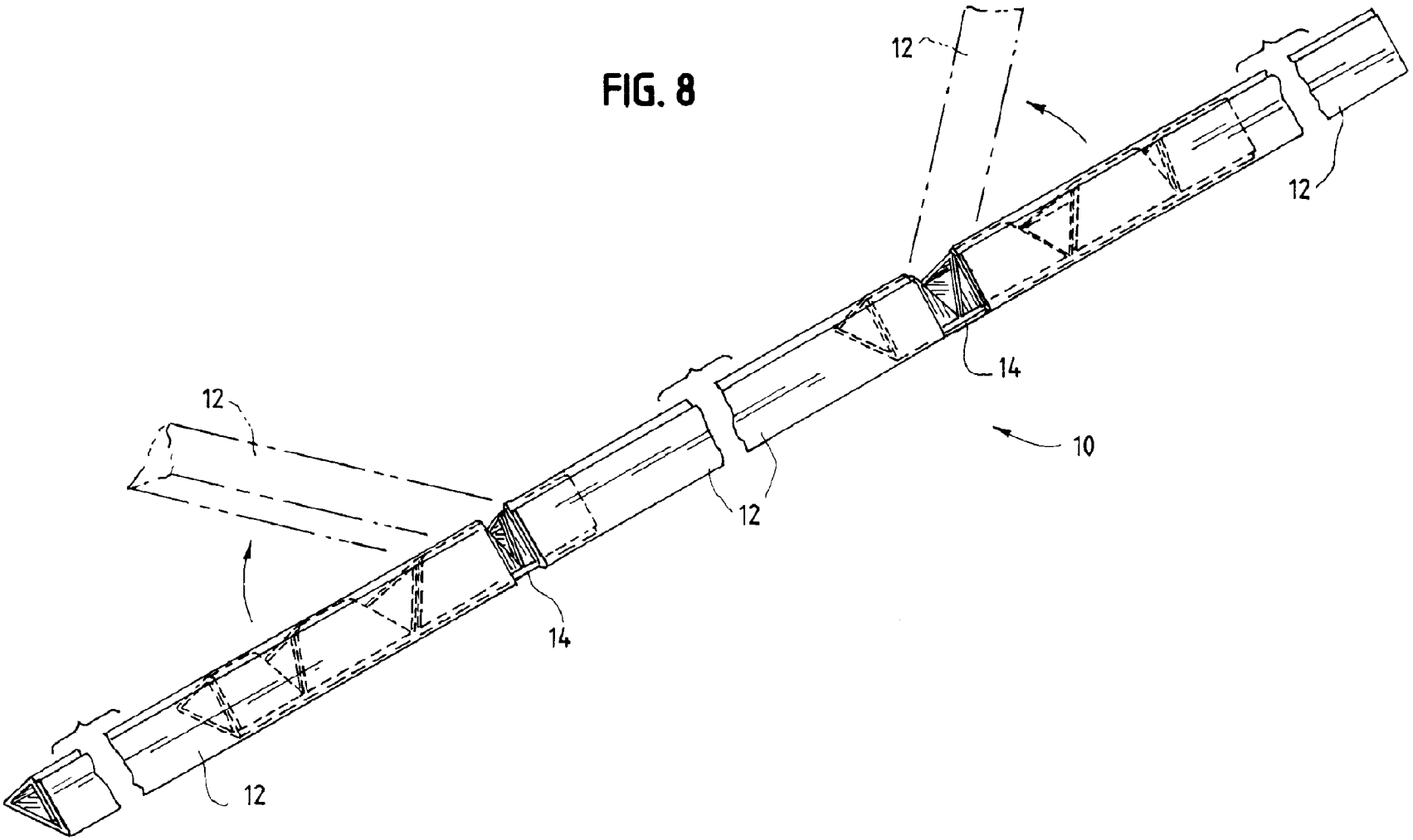
FIG. 8 is a perspective view of the multiple angle tubular container of FIG. 1 shown in a straight position and in phantom lines in an angled position.

FIG. 8 is a perspective view of the multiple angle tubular container 10 of FIG. 1 before and, in phantom lines, after it has been folded or bent. To assemble the container 10 shown in FIG. 8, two connectors 14 are inserted inside either end of the center straight section 12 up to the desired V-shaped notch 16. The two connectors 14 may be slid up to V-shaped notches 16 having the same or different angles, depending on the desired bending characteristics of the container 10. Two more outer straight sections 12 are then slid over the connectors 14 up to the same V-shaped notches 16. The V-shaped notches 16 at which the container is to be bent must be completely exposed, and not covered by the outer straight sections 12, to enable the container 10 to be fully bent. The assembled container 10 can then be bent up to the predetermined angle(s) of the notches 16 using the connectors 14 as hinges.

Any number of outer straight sections 12 may be connected using the connectors 14. The connectors 14 and straight sections 12 may be glued or otherwise affixed to each other. Optional end caps (not shown) may be used to cover the exposed ends of the container 10.

The straight sections 12 and connectors 14 may be slid over the item to be protected. Alternatively, if the straight sections 12 and/or connectors 14 cannot be slid past any bends or angles in the item, the straight sections 12 and/or connectors 14 may be folded and glued around the item. In the latter instance, to remove the item the straight sections 12 and/or connectors 14 may be disassembled or destroyed.

Figure 7:
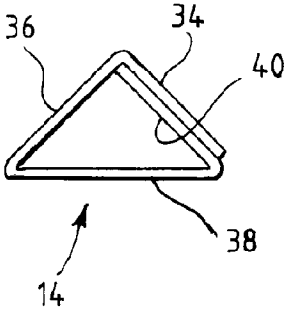
FIG. 7 is an elevational view of an end of the connector of FIG. 4.

In an alternative embodiment, the container 10 comprises only a notched connector piece 14 such as that shown in FIGS. 5-7. As with the preferred embodiment, the connector piece 14 can be bent by folding it along the un-notched (bottom) panel 38 to butt the opposing edges 44 of a notch 16.

Other modifications and alternative embodiments of the invention are contemplated which do not depart from the spirit and scope of the invention as defined by the foregoing teachings and appended claims. It is intended that the claims cover all such modifications that fall within their scope.

What is claimed is:

1. A tubular container for holding non-straight articles, the container comprising:

at least one straight section formed from a first blank folded to form a hollow tubular structure having a triangular cross section; and at least one hinged section formed from a second blank, the second blank comprising four transversely arranged, substantially rectangular panels, the four substantially rectangular panels consisting of a bottom panel, two side panels joined to opposite sides of the bottom panel along parallel, longitudinally extending, first fold lines and an overlapping panel joined to one of the side panels along a second fold line parallel to the first fold lines, the second blank further comprising first, second and third transversely aligned, substantially V-shaped cut out sections, the first cut out section disposed in one of the side panels, the second cut out section disposed in the other of said side panels and the third cut out section disposed in the overlapping panel, each of the first and second cut out sections having an apex contacting one of the first fold lines, there being a hinge line extending transversely across the bottom panel between the apexes of the first and second cut out sections, the second blank being folded along the first and second fold lines and the overlapping panel being affixed to one of the side panels to form a second hollow, tubular structure having a triangular cross section;

wherein the at least one straight section and the at least one hinged section are connected by inserting one section inside an end of the other section; and wherein the tubular container can be bent along the hinge line to achieve a container in which the at least one straight section and the at least one hinged section define a non-180 degree angle.

2. The container of claim 1 wherein the container comprises at least two hinged sections.

3. The container of claim 1 wherein the at least one hinged section is inserted into the at least one straight section.

4. The container of claim 1 wherein each V-shaped cut out section comprises opposing edges joined at the apex, and wherein the hinged section is capable of being rotated about the hinge line until the opposing edges butt against each other to form an enclosed container.

5. A tubular container for holding non-straight articles, the container comprising:

at least one straight section formed from a first blank folded along fold lines to form a hollow tubular structure having a triangular cross section; and at least one hinged section connected to the straight section by the insertion of one section inside the other section, the hinged section formed from a second blank folded along fold lines to form a three-sided hollow tubular structure, the hinged section comprising a V-shaped notch formed in two sides such that the hinged section can be bent along a hinge line formed in the third side to assume an angular shape.

* * * * *